United States Patent [19]

Ciccarone et al.

[11] Patent Number: 4,884,539

[45] Date of Patent: Dec. 5, 1989

[54] HEAD FOR AN INTERNAL COMBUSTION RECIPROCATING ENGINE

[75] Inventors: Angelo Ciccarone, Milan; Emilio Oldani, Cerro Maggiore; Pier L. Scapecchi, Saronno, all of Italy

[73] Assignee: Alfa Lancia Industries S.p.A, Arese, Italy

[21] Appl. No.: 133,881

[22] Filed: Dec. 16, 1987

[30] Foreign Application Priority Data

Dec. 17, 1986 [IT] Italy ..... 22733 A/86

[51] Int. Cl.[4] ..... F02F 1/42; F02M 35/10; F02P 15/02

[52] U.S. Cl. ..... 123/310; 123/41.82 R; 123/188 M; 123/193 H

[58] Field of Search ..... 123/41.72, 41.82 R, 123/41.82 A, 193 CH, 193 H, 310, 188 M

[56] References Cited

U.S. PATENT DOCUMENTS

| | | | |
|---|---|---|---|
| 2,182,990 | 12/1939 | Kishline | 123/41.82 A |
| 2,640,422 | 6/1953 | Malin | 123/310 X |
| 3,062,614 | 11/1962 | Stancliff et al. | 123/41.82 R |
| 4,116,176 | 9/1978 | Hayashi et al. | 123/310 X |
| 4,116,181 | 9/1978 | Nakajima et al. | 123/310 |
| 4,320,725 | 3/1982 | Rychlik et al. | 123/188 M |
| 4,452,198 | 6/1984 | Berland | 123/310 |
| 4,622,940 | 11/1986 | Yoshikawa | 123/188 M X |
| 4,754,729 | 7/1988 | Abe et al. | 123/193 H X |

*Primary Examiner*—Willis R. Wolfe, Jr.

*Attorney, Agent, or Firm*—Charles E. Brown; Charles A. Brown

[57] ABSTRACT

The present invention is concerned with a head for an internal combustion reciprocating engine, with a couple of spark-plugs for each combustion chamber, wherein the structure of the head is optimized in order to improve the preformance of the engine, and to secure the necessary structural stiffness.

18 Claims, 7 Drawing Sheets

HEAD FOR AN INTERNAL COMBUSTION RECIPROCATING ENGINE

Figure 1:
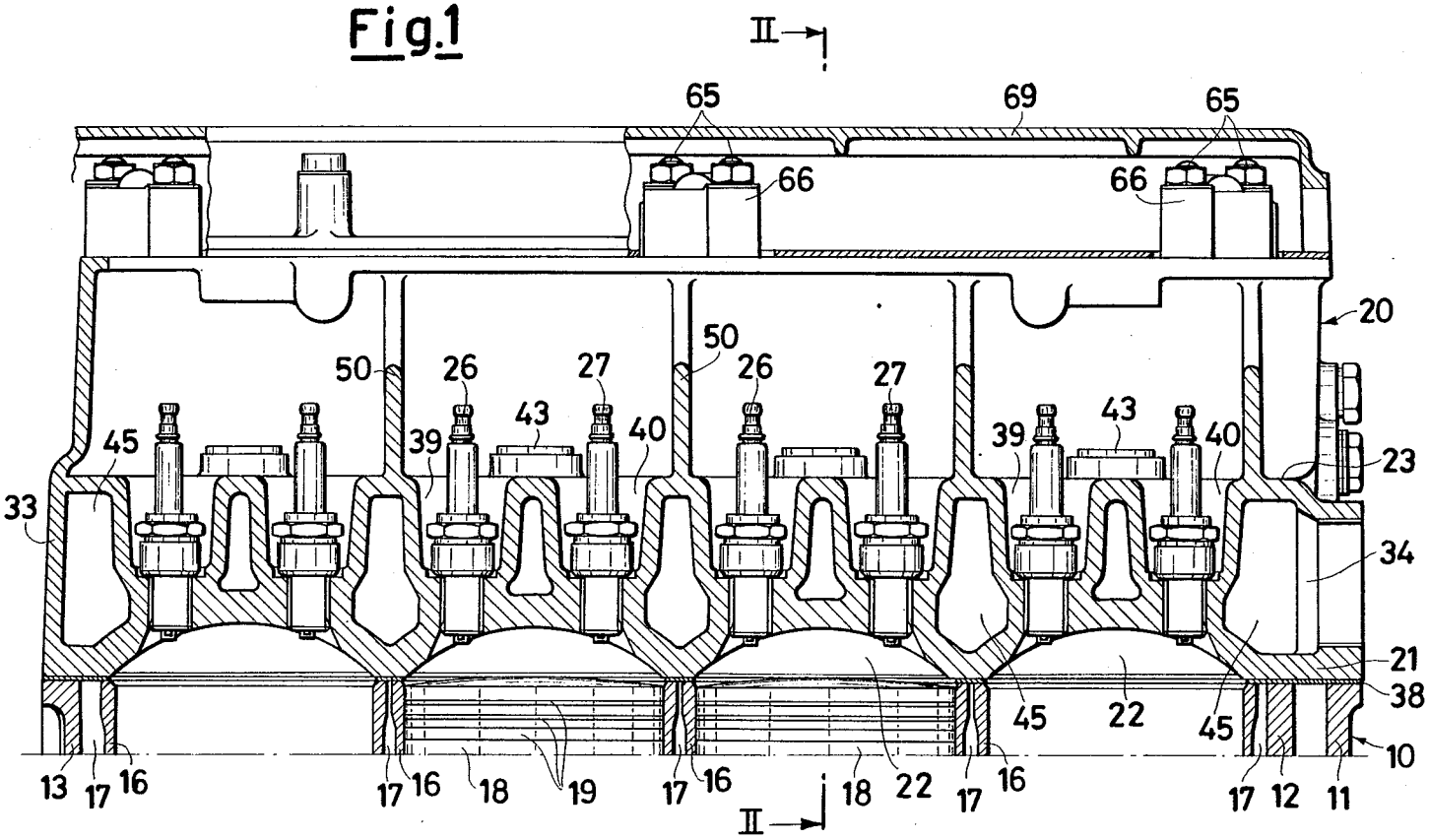

Internal combustion engines, equipped with a couple of spark-plugs per each combustion chamber are known, wherein a more complete, rapid, stable and gradual combustion of the mixture takes place, than in engines with one spark-plug per combustion chamber only, because the path of propagation of the flame front is shorter, and the different points of the combustion chamber are reached within shorter times. Furthermore, also the cyclic dispersion of the combustion ignition point results to be more reduced, thanks to the higher probability of having the correct mixture ratio in the nearby of at least one from the two ignition points, than in the usual single-point configuration.

As a consequence, leaner mixtures can be used, without penalizing the torque and maximum power performance of the engine, with advantages due to the reduction in fuel consumption, and also due to the reduction of unburnt pollutants, such as carbon oxide (CO) and unburnt hydrocarbons (HC), in the exhaust gases.

The more regular behaviour of the combustion in the engine improves also the drive ability of the vehicle, in particular under partial loads.

Providing substantially semi-spherical combustion chambers, in order to improve the surface/volume ratio thereof, is known as well.

The purpose of the present invention and of our investigations is to provide heads for internal combustion engines provided with substantially semi-spherical combustion chambers, equipped with a couple of spark-plugs which, with the barrel bore being the same, show a reduced volume and are particularly compact, with a favourable surface/volume ratio.

These purposes have been achieved according to the present invention by providing a head for an internal combustion reciprocating engine, wherein the intake and exhaust valves are located with acute, rather narrow, angles of inclination relatively to the vertical axis of the combustion chamber. Said axis is furthermore coincident with the axis of the cylinder.

Preferably, said acute inclination angles are smaller than 25°.

Furthermore, the intake and exhaust valves are closely approached to the centre of said combustion chamber.

Thus, advantageously, in the head, less deep combustion chambers can be provided, and pistons having a practically flat head can be used; that makes it possible the compression ratio to be increased, and the heat exchange surfaces to be reduced, with the further advantage than higher efficiencies can be obtained both under partial loads, and under conditions of full opening of the choking valve.

Further favourable results and advantages have been achieved according to the invention, by preferably providing in the head intake ducts having their axes inclined through an angle smaller than 70° relatively to the vertical axis of the combustion chamber.

Preferably, said inclination angle will be comprised within the range of from 65° to 60°.

Thus, a reduction in the pressure drop in correspondence of the inlet openings of the combustion chamber, and, consequently, a better filling of the cylinders at all revolution speeds, in particular at high revolution speeds, has been obtained.

Furthermore, an increase has been obtained in the torque and in the maximum power supplied by the engine, such an increase being to be attributed both to the improvement in the filling, and to the higher combustion efficiency due to the shape of the combustion chamber.

The improvement in combustion, and the increase in maximum power cause large increases in pressure inside the combustion chamber, in particular under the high loads, with consequent high mechanical and thermal stresses being applied to the engine head.

To the end of preventing deformations due to tightening loads and thermal loads, besides the arising of noisiness and troublesome disturbances, and of furthermore avoiding the risk that cracks may occur, which would endager the engine life, according to the present invention, the head has been strengthened by means of stiffening wall elements, which make it possible a concentrated strength in the most stressed regions, such as the combustion chambers, and a circulation of the cooling liquid such to secure an uniform heat dispersion, to be obtained.

For this purpose, according to the present invention, the head has been made monolithic, and shows a lower structure, which is formed by two substantially horizontal walls, wherein, in the first wall, combustion chambers have been provided, and wherein said first and said second walls are connected by substantially vertical perimetrical walls, intake and exhaust ducts, substantially vertical wells to house the spark-plugs, studs suitable to receive the stud bolts for the fastening to the engine block, so to make said elements advantageously perform also a function of structural strength.

Thus, in correspondence of the combustion chambers an adequately strong structure has been realized, which, at the same time, leaves wide passages free for the head cooling fluid to flow through.

Furthermore, and preferably, the head shows an upper structure, which is formed by substantially vertical inner, longitudinal and transversal walls, which connect said second, substantially horizontal, wall with said substantially vertical, peripheral walls; these inner walls further contributing to the structural strength of the head.

Structural and functional characteristics, and advantages of the present invention will be now illustrated by referring to the following figures, wherein for exemplifying and non-limitative purposes a preferred form of practical embodiment is shown of a head for an internal combustion reciprocating engine according to the present invention.

Figure 2:
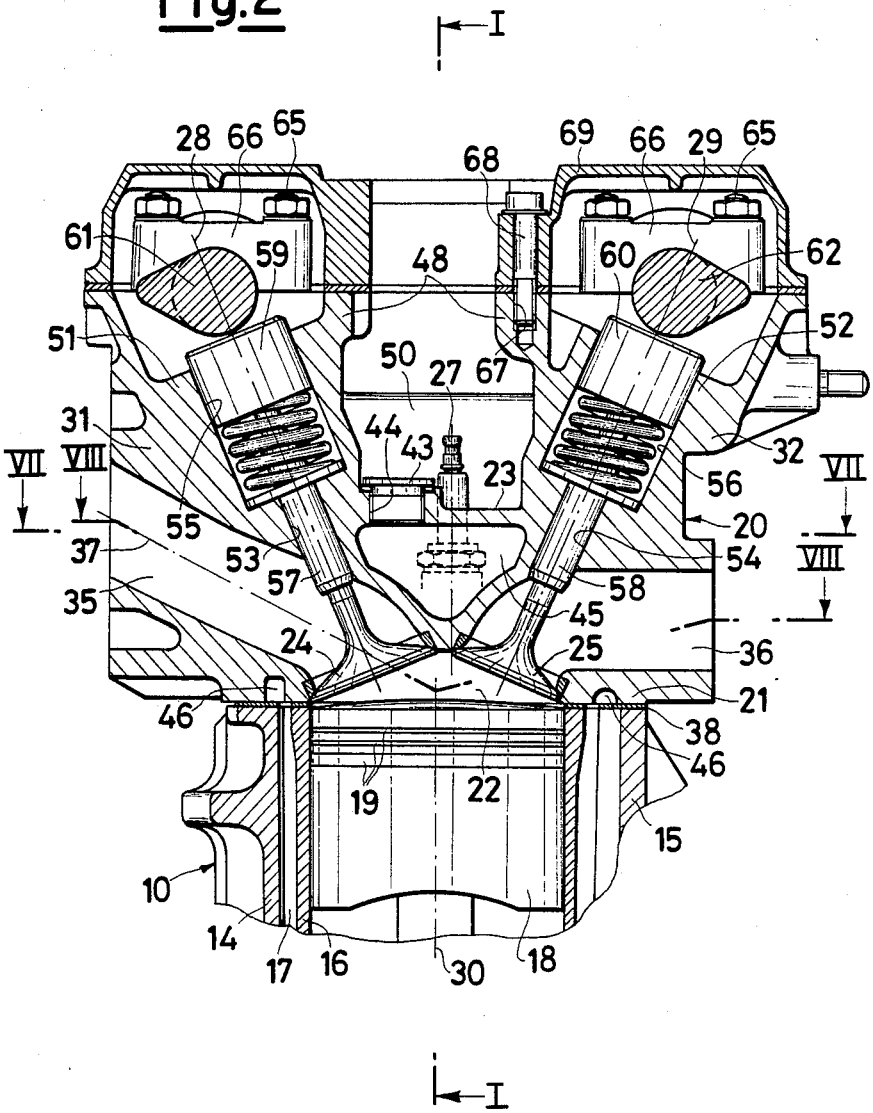
Figure 3:
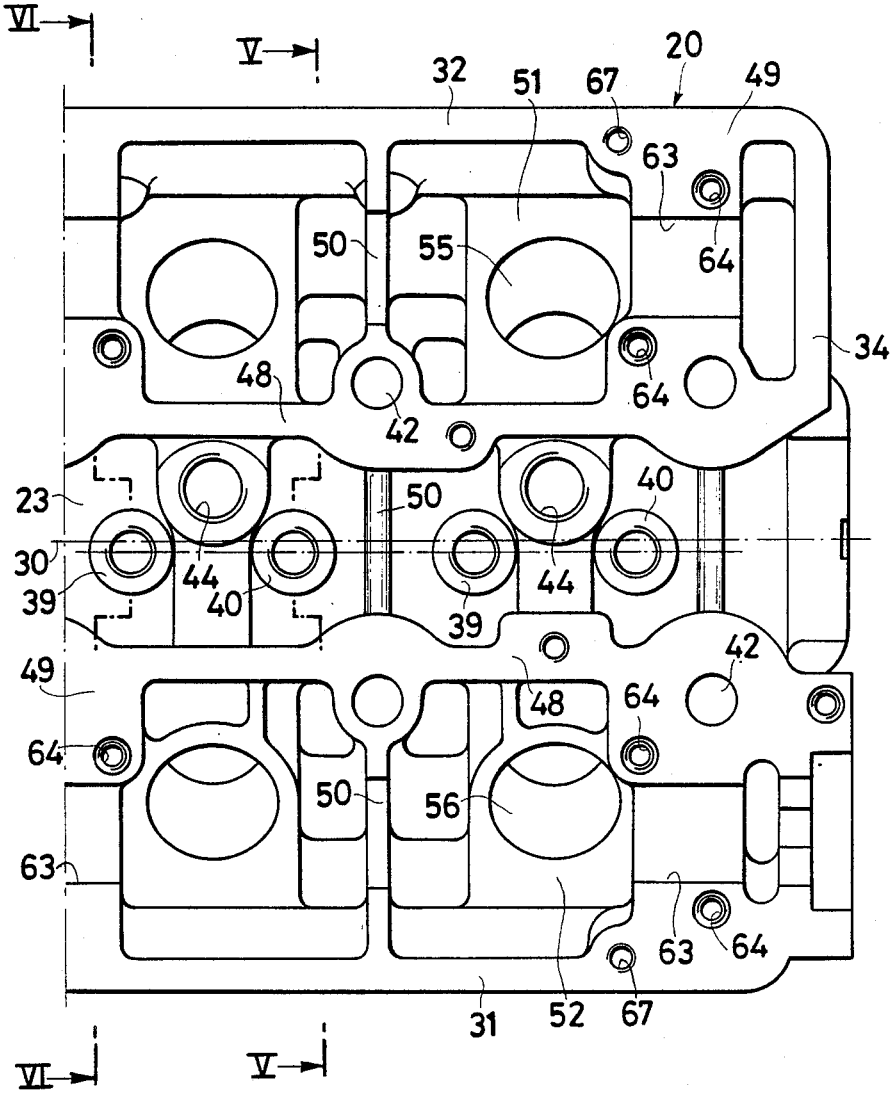
Figure 4:
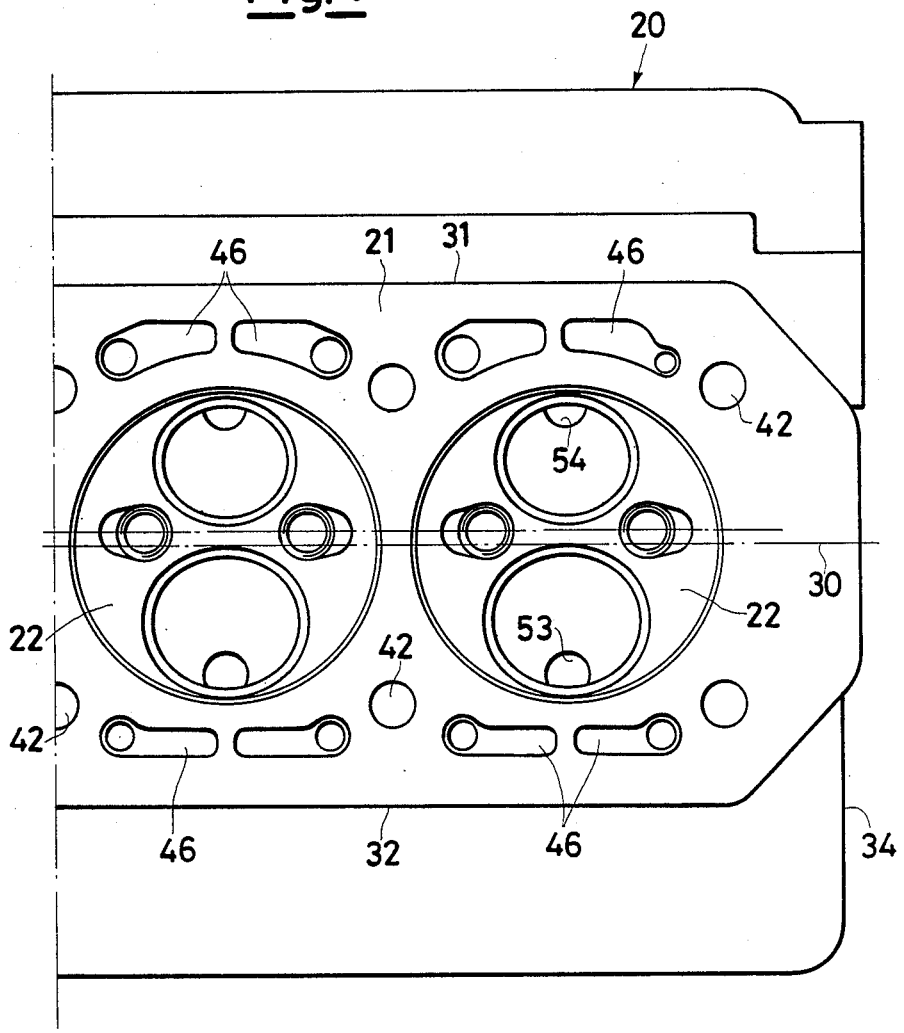
Figure 5:
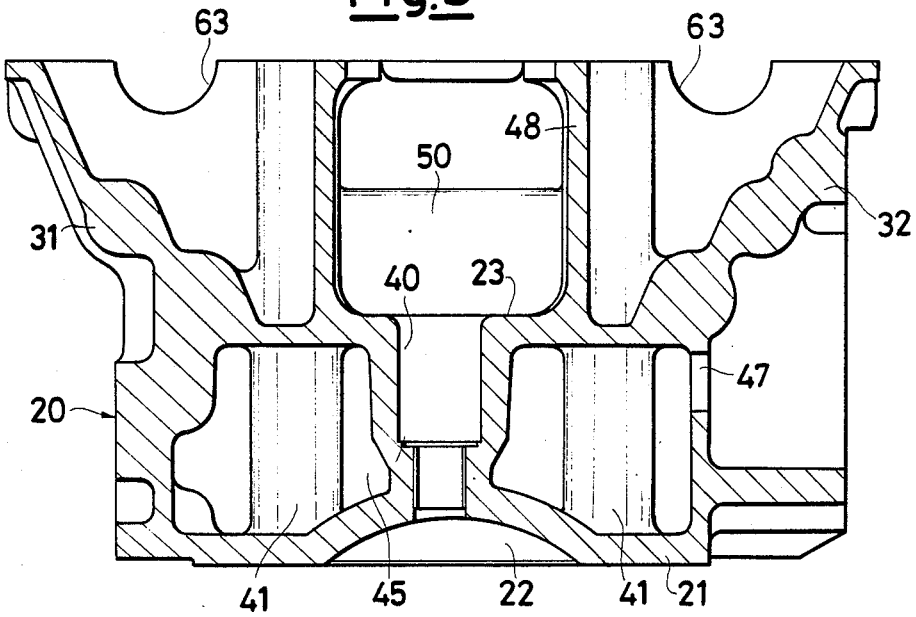
Figure 6:
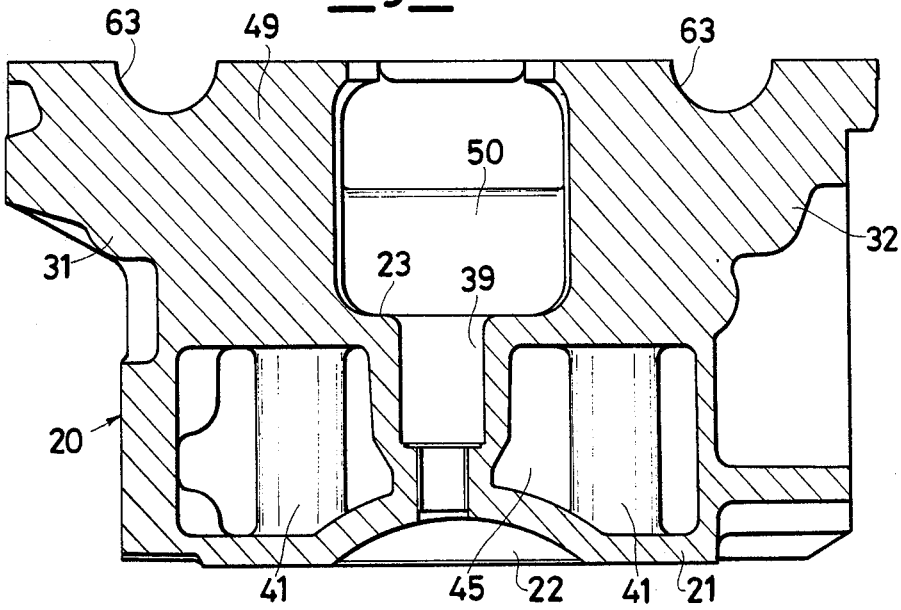
Figure 7:
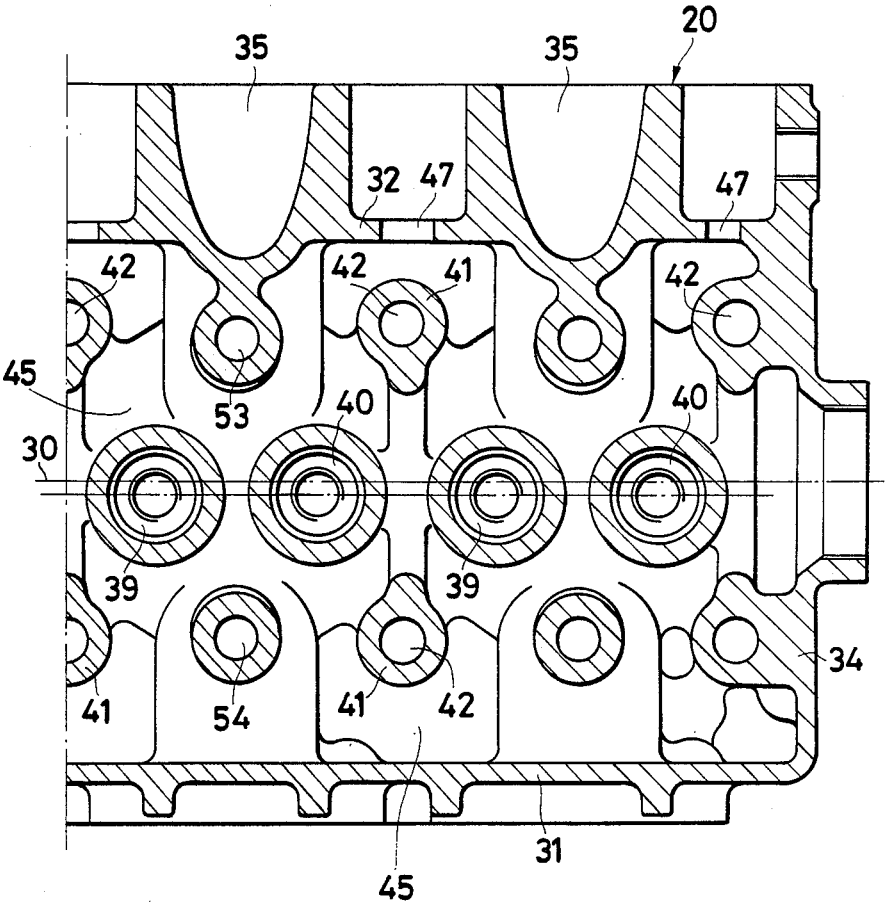
Figure 8:
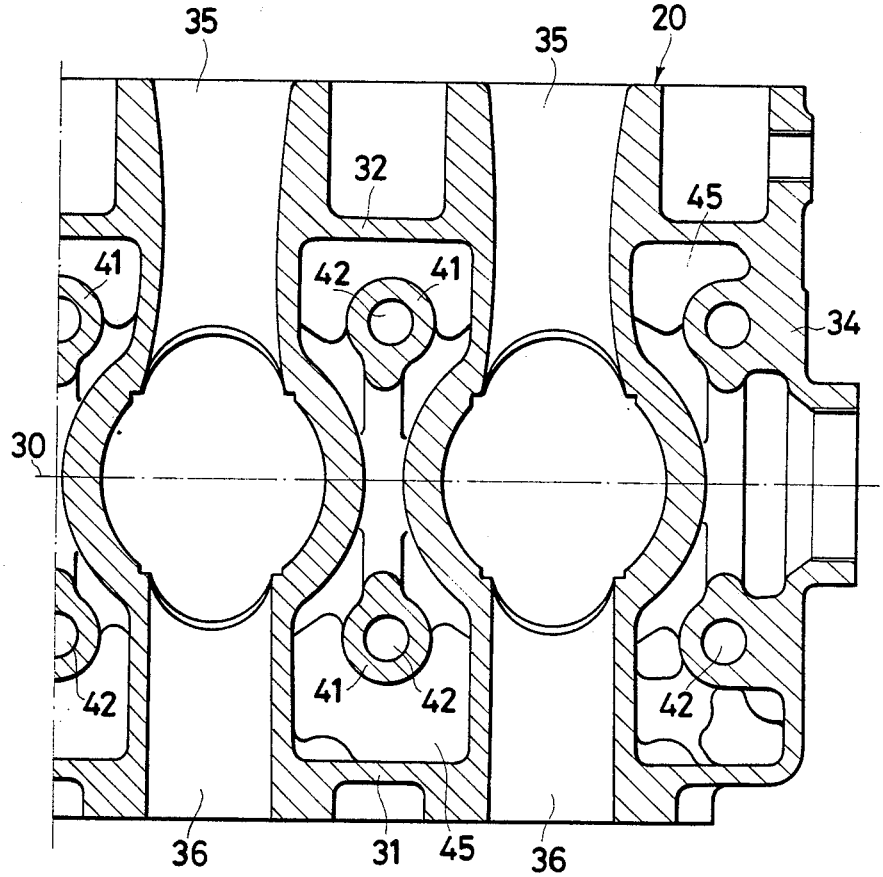

FIG. 1 shows a longitudinal elevation view of an engine according to path I—I of FIG. 2, FIG. 2 shows a transversal sectional view according to path II—II of FIG. 1, FIG. 3 shows a partial top plan view of the only structure of the head of the engine, FIG. 4 shows a partial bottom plan view of the head of FIG. 3, FIG. 5 shows a transversal sectional view according to path V—V of FIG. 3, FIG. 6 shows a transversal sectional view according to path VI—VI of FIG. 3, FIG. 7 shows a partial sectional view of the only body of the head according to path VII—VII of FIG. 2, and FIG. 8 shows a partial sectional view of the only body of the head according to path VIII—VIII of FIG. 2.

In FIG. 1, the block of an internal combustion reciprocating engine, e.g., of the straight, four-cylinder type, is generally shown by the reference numeral 10; in FIG. 1, transversal walls 11, 12, 13 thereof are visible; and in FIG. 2, longitudinal walls 14, 15 thereof are visible.

The barrels of the cylinders, each of which is indicated by the reference numeral 16, are fastened, at the bottom, inside the engine block 10, in a known, and hence not displayed, way. The chambers through which the coolant for the same cylinders circulates are indicated by the reference numeral 17.

In FIG. 1, only two of the pistons sliding inside the barrles 16 are shown; the pistons, whose head is practically flat, are indicated by the reference numeral 18, and sets of three compression rings thereof are indicated by the reference numeral 19.

The motor head, generally indicated by the reference numeral 20, is constituted by a lower structure comprising two substantially horizontal walls, i.e., a first wall, indicated by the reference numeral 21, wherein combustion chambers 22 are provided, and a second wall, indicated by the reference numeral 23. Inside each chamber 22 there are an intake valve 24, and an exhaust valve 25, visible in FIG. 2, and a couple of spark plugs 26 and 27, which are visible in FIGS. 1 and 2. As it results from the Figures, the spark-plugs 26 and 27 are positioned with their axes lying on a plane perpendicular to the plane which contains the axes 28 and 29 of the valves, with said plane being positioned offset, by a certain distance, from the centre of the combustion chamber; in particular, the spark-plugs 26 and 27 are vertical, and equidistant from the centre of the combustion chamber.

The vertical arrangement of the spark-plugs facilitates the machining of their seats, so that the total head machining costs are reduced.

The valves, in their turn, are closely approached to the centre of the combustion chamber, and are positioned with their axes 28 and 29 inclined through narrow acute angles relatively to the vertical axis 30 of the same combustion chamber. Preferably, said acute angles are smaller than 25°.

The substantially horizontal walls 21 and 23 are connected by substantially vertical perimetrical walls, i.e., longitudinal walls 31 and 32, and transversal walls 33 and 34, visible in FIGS. 1, 2, 4; the same walls 21 and 23 are also connected by the tubes which form intake ducts 35 and exhaust ducts 36.

The axes of the intake ducts, one of which is indicated by the reference numeral 37 in FIG. 2, are inclined through an angle smaller than 70°, preferably comprised within the range of from 65° to 60°, relatively to the vertical axis 30 of the combustion chamber 22.

By 38, a sealing gasket interposed between the block 10 and the head 20, is indicated.

The substantially horizontal walls 21 and 23 are furthermore connected by couples of substantially vertical wells 39 and 40, wherein the spark-plugs 26 and 27 are housed.

The walls 21 and 23 are furthermore connected by studs or sleeves 41, visible in FIGS. 5, 6, 7 and 8, whose internal bores 42 house the stud bolts, not shown, which fasten the head 20 to the block 10.

Thus, the ducts 35 and 36, the wells 39 and 40, the studs 41, also perform the function of structural strengthening elements. In FIGS. 1 and 2, plugs 43 are visible, which close bores 44 provided on the wall 23, visible in FIGS. 2 and 3, for the passage of the head casting cores.

Inside a chamber 45, or multichamber, comprised between the substantially horizontal walls 21 and 23, and the vertical walls 31–34, the head 20 cooling liquid circulates, coming from the chambers 17 of the engine block 10, through passages indicated by the reference numeral 46 in FIGS. 2 and 4.

The cooling liquid leaves the head through bores indicated by the reference numeral 47 in FIGS. 5 and 7, whose location has been studied in order to optimize the flow of the same liquid and the heat dispersion. The head 20 shows an upper structure which is formed by substantially vertical longitudinal walls 48, high-thickness transversal walls 49, low-thickness transversal walls 50, which connect the wall 23 with the walls 31–34, as shown in the figures.

The enlargements formed at the crossing of said longitudinal and transversal walls are radiused with the studs or sleeves 41, and are provided with the same inner bores 42.

The walls 48 are furthermore connected with the wall 23 and with the walls 31 and 32 by means of blocks 51 and 52, inside which seats 53 and 54 for the valve guides, and seats 55 and 56 for respectively the intake and exhaust valves actuation cups, visible in FIGS. 2, 3 and 4, are provided.

In FIG. 2, valve guides 57 and 58, valve actuation cups 59 and 60, and all of the elements in engagement with the valves 24 and 25 are visible; they are not described in detail, because they are known.

Shafts and cams 61 and 62, which actuate the valves, are shown in sectional view.

As shown in FIGS. 3, 5 and 6, in the transversal walls 49, seats 63 are provided, to house the bearings of the cam shafts 61 and 62.

In the same walls 49, also threaded bores 64 are provided, wherein stud bolts 65 have to be screwed down, to lock the brackets 66 supporting the cam shafts 61 and 62; also shown in FIGS. 1 and 2 are then threaded bores, indicated by the reference numeral 67, inside which stud bolts 68 have to be screwed down, in order to fasten to the head a cover 69, still shown in FIGS. 1 and 2.

With the illustrated engine head, wherein the combustion chambers 22, of substantially semi-spherical shape, show a small volume, and a small surface/volume ratio, an increase in the compression ratio, and a reduction in heat exchange surfaces have been achieved.

Furthermore, by positioning the intake ducts in a fairly inclined position, the volumetric efficiency of the engine has been increased.

An increase in engine torque and maximum power resulted.

Finally, the special configuration of the elements performing functions of structural strength, made it possible to accomplish a particularly strong head, capable of withstanding the strong mechanical and thermal stresses deriving from the improvement in performance.

We claim:

1. A cylinder head for an internal combustion reciprocating engine which has cylinders, pistons and a circuit through which a cooling liquid is moved, said cylinder head having combustion chambers with a substantially semispherical shape, each combustion chamber having means for mounting a pair of spark plugs, each combustion chamber further having at least an intake valve and an exhaust valve positioned within respective intake and exhaust ducts, each intake valve and each exhaust valve of an associated combustion chamber being positioned with each axis inclined at an acute angle to a vertical axis of said associated combustion chamber, said means for mounting the pair of spark plugs holding the same pair of spark plug axes to lie on a second plane which is perpendicular to a first plane containing said axes of said intake and exhaust valves, said second plane being off-set to the center of said associated combustion chamber.

2. The cylinder head according to claim 1, wherein each intake duct is positioned with its axis being inclined through an angle smaller than 70° relatively to the vertical axis of the associated combustion chamber.

3. A cylinder head for an internal combustion reciprocating engine which has cylinders, pistons and a circuit through which a cooling liquid is moved, said cylinder head having combustion chambers with a substantially semispherical shape, each combustion chamber having means for mounting a pair of spark plugs, each combustion chamber further having at least an intake valve and an exhaust valve positioned within respective intake and exhaust ducts, each intake valve and each exhaust valve of an associated combustion chamber being positioned with each axis inclined at an acute angle to a vertical axis of said associated combustion chamber, wherein each intake duct is positioned with its axis being inclined through an angle smaller than 70° relatively to the vertical axis of the associated combustion chamber, said means for mounting the pair of spark plugs holding the same pair of spark plug axes to lie on a second plane which is perpendicular to a first plane containing said axes of said intake and exhaust valves, said second plane being off-set to the center of said associated combustion chamber.

4. The cylinder head according to claim 3, wherein the axes of the pair of spark plugs are positioned substantially equidistant from said first plane of the axes of said valves.

5. The cylinder head according to claim 3, wherein the angle of each intake duct is within the range of from 65° to 60°.

6. The cylinder head according to claim 3, wherein said combustion chambers are bounded by pistons having a substantially flat head.

7. A cylinder according to claim 3, wherein the acute angle of said intake and exhaust valves axes to the vertical axis of said associated combustion chamber is an angle smaller the 25°.

8. A cylinder head according to claim 3, wherein the axes of the pair of spark plugs are also positioned substantially vertically parallel to the vertical axis of the combustion chamber.

9. A cylinder head for an internal combustion reciprocating engine which has cylinders, pistons and a circuit through which a cooling liquid is moved, said cylinder head having combustion chambers with a substantially semispherical shape, each combustion chamber having means for mounting a pair of spark plugs, each combustion chamber further having at least an intake valve and an exhaust valve positioned within respective intake and exhaust ducts, each intake valve and each exhaust valve of an associated combustion chamber being positioned with each axis inclined at an acute angle to a vertical axis of said associated combustion chamber, wherein each intake duct is positioned with its axis being inclined through an angle smaller than 70° relatively to the vertical axis of the associated combustion chamber, said cylinder head having a lower structure formed to two substantially horizontal walls, in a first wall of said horizontal walls said combustion chambers being provided, said two horizontal walls being connected by substantially vertical perimetrical walls, tubes forming said intake and exhaust ducts, wells being formed inside the other of said horizontal walls in which the spark plugs are housed.

10. The cylinder head according to claim 9, wherein said wells are substantially vertical.

11. The cylinder head according to claim 9, wherein said substantially horizontal walls have bores which house stud bolts, the stud bolts are for fastening of said cylinder head to the engine block.

12. The cylinder head according to claim 9, wherein said combustion chambers are operatively connected to the circuit of the engine cooling liquid.

13. The combustion head according to claim 9, wherein said head also comprises an upper structure formed by substantially vertical, longitudinal and transversal, walls, which connect said second, substantially horizontal wall with said, substantially vertical walls.

14. The combustion head according to claim 13, wherein said head comprises blocks wherein seats are provided the valve guides and valve actuation cups, wherein said blocks connect said longitudinal walls with the perimetrical walls and with the second, substantially horizontal wall.

15. The cylinder head according to claim 13, wherein the enlargements formed at crossing of said longitudinal and transversal walls are radiused with bored studs for said stud bolts.

16. The cylinder head according to claim 9, wherein the axes of the pair of spark plugs are positioned substantially equidistant from said first plane of the axes of said valves.

17. The cylinder head according to claim 9, wherein the angle of each intake duct is within the range from 65° to 60°.

18. The cylinder head according to claim 9, wherein said combustion chambers are bounded by pistons having a substantially flat head.

* * * * *

UNITED STATES PATENT AND TRADEMARK OFFICE

CERTIFICATE OF CORRECTION

PATENT NO. : 4,884,539

DATED : December 5, 1989

INVENTOR(S) : Angelo Ciccarone; Emilio Oldani and Pier Luigi Scapecchi

It is certified that error appears in the above-identified patent and that said Letters Patent is hereby corrected as shown below:

Title page:

[73] Assignee:

Change "Alfa Lancia Industries S.p.A." to read

-- Alfa Lancia Industriale S.p.A. --

Signed and Sealed this

First Day of October, 1991

*Attest:*

*Attesting Officer*

HARRY F. MANBECK, JR.

*Commissioner of Patents and Trademarks*